US005376143A

United States Patent [19]

Wasinger et al.

[11] Patent Number: 5,376,143

[45] Date of Patent: * Dec. 27, 1994

[54] DECOLORIZATION OF FABRICS

[75] Inventors: Eric Wasinger, 200 S. Blair St. Apt. I P.O. Box 886, Adamsville, Tenn. 38310; David Hall, Auburn, Ala.

[73] Assignee: Eric Wasinger, Adamsville, Tenn.

[ * ] Notice: The portion of the term of this patent subsequent to Jun. 2, 2009 has been disclaimed.

[21] Appl. No.: 125,868

[22] Filed: Sep. 27, 1993

Related U.S. Application Data

[60] Division of Ser. No. 804,250, Dec. 9, 1991, Pat. No. 5,261,925, which is a continuation-in-part of Ser. No. 560,357, Jul. 31, 1990, Pat. No. 5,118,322.

[51] Int. Cl.[5] ..... D06L 3/02; D06L 3/04; D06L 3/08

[52] U.S. Cl. ..... 8/111; 8/101; 8/102; 8/107; 8/108.1; 8/110; 8/149.1; 8/149.2; 8/149.3; 8/478; 8/483

[58] Field of Search ..... 8/101, 102, 111, 478, 8/472, 483, 116.1, 107, 108.1, 149.2, 149.3, 110, 149.1

[56] References Cited

U.S. PATENT DOCUMENTS

| | | | |
|---|---|---|---|
| 354,798 | 12/1886 | Lorimer | 8/149.2 |
| 4,214,330 | 7/1980 | Thorsen | 8/149.2 |
| 5,118,322 | 6/1992 | Wasinger et al. | 8/111 |
| 5,261,925 | 11/1993 | Wasinger et al. | 8/111 |

FOREIGN PATENT DOCUMENTS 593933 9/1925 France .

OTHER PUBLICATIONS

Hackh's Chemical Dictionary, 4th edition, 1969, p. 648.

*Primary Examiner*—Prince Willis, Jr.
*Assistant Examiner*—Alan D. Diamond
*Attorney, Agent, or Firm*—John Lezdey

[57] ABSTRACT

A process for selectively decolorizing a fabric containing cellulosic material oxidizable colorants which comprises the steps of wetting the fabric and then contacting the wetted fabric with an oxidizing gas or vapor. The contact with the oxidizing gas or vapor is terminated before any substantial degradation of the fabric occurs.

5 Claims, 1 Drawing Sheet

DECOLORIZATION OF FABRICS

RELATED APPLICATION

This is a divisional application of Ser. No. 07/804,250, filed Dec. 9, 1991, now U.S. Pat. No. 5,261,925 which is a continuation-in-part of application Ser. No. 07/560,357, filed Jul. 31, 1990 now U.S. Pat. No. 5,118,322 of Hall et al entitled "Ozone Decolorization of Garments".

FIELD OF THE INVENTION

The present invention relates to the fading or decolorization of dyes or coloring agents on fabrics. More particularly, the invention is concerned with the decolorization and/or fading of garments containing cellulosic materials which contain an oxidizable dye or coloring agent through the use of oxidizing gases without any substantial deterioration of the garment. The invention is particularly useful in preparing fashion garments such as faded denim blue jeans, and the like, without the use of harsh chemical bleaches or the abrasive effects of stones, pumice, sand or the like.

BACKGROUND OF THE INVENTION

Denim blue jeans which have been faded, "stonewashed", ice washed, or sand blasted to produce a particular appearance are very popular. However, to produce the desired effect it has been necessary to utilize processes which cause substantial deterioration or degradation of the fabric. Bleaching solutions containing chlorine or actual pelleting of the garment with sand or stones to produce a fashion effect causes damage to the fabric which affects its wear,life.

The woven goods that are made into denim are typically manufactured from warp yarns (yarns that are in the machine direction on the loom) that have been dyed with Indigo (CI vat blue 1). The crosswise or filling yarns are typically undyed. The yarns are woven in such a way so as to place a high proportion of the colored (blue dyed) yarns on the face of the fabric. This is typically done by weaving the yarns using one of the twill weaves. The result is a fabric which is characteristically known as Blue Jeans when fabricated into garments. It has been discovered that bleaching of the Indigo color by one of a number of techniques can lead to desirable styling effects. Several of the bleaching or decolorizing treatments involves potassiums(or sodium) permanganate. This compound is the agent of choice when obtaining staying effects by the acid wash or stone wash technique.

Occasionally, garments which have been treated by these methods undergo yellowing during storage of the garments during warehousing and prior to shipment to the retailer or while in the retailers possession if he stores them for any length of time.

The precise causes for the yellowing phenomena is not known. Several possible causes have been identified to include finishing agents (added to the garment to provide a softer hand etc.), atmospheric pollutants or to degradation products associated with the permanganate reactions Which are not properly removed during the treatments among other causes. However, not all garments will be yellowed in a particular lot or shipment. The yellowing phenomena may not manifest itself until after the garments have been stored or shipped to the customer. Most likely the yellowed garments do emanate from a particular laundry cycle or machine; however, after the treated garments are removed from the machine the garments from the affected treatment cycle may then become mixed with those from other machines such that their processing lot identity becomes lost. Usually the contaminated (yellow) garments are returned to the seller or are sold at a considerably reduced price.

Another source of yellowing is the usual type of yellowing that is encountered world wide, that is, in all areas of the world and on all types of fibers. Usually the causative agent works on the fibers themselves or on some material that was either accidentally or deliberately added to the fabric. Some of the factors which are found to cause such yellowing in fabrics or garments are optical brighteners and finishing agents, atmospheric pollutants, sulfides and lignins in paper and cardboard, antioxidants used in packaging materials among others. Perhaps the most common and major cause for yellowing is due to the reaction of antioxidants with oxides of nitrogen to produce yellow compounds. Of these, butylated hydroxytoluene (BHT), is the most common contaminate causing such yellowing. It has been found that as little as 2 ppm of this compound on the fabric or garment can result in significant yellowing. This compound has widespread use in the industry because of its effectiveness, and the fact that it is fairly inexpensive and easy to obtain.

Ozone has been used in the bleaching of cellulosic materials. U.S. Pat. No. 4,283,251 to Singh discloses the bleaching of cellulosic pulp with gaseous ozone in an acidic pH followed by an alkaline treatment.

U.S. Pat. Nos. 4,214,330 and 4,300,367 to Thorsen, which are herewith incorporated by reference, describe a method and an apparatus for treatment of undyed fabrics with a ozone-steam mixture. The process is used to shrinkproof the fabric with a minimum amount of deterioration of the fabric fibers. The ozone treatment reacts with the undyed fibers and provides whiter fibers. The treatment is stated to increase subsequent dyeability and dye fastness of the garment.

W. J. Thorsen et al in their paper entitled, "Vapor-Phase Ozone Treatment of Wool Garments", *Textile Research Journal*, Textile Research Institute, 1979, p. 190–197, describe the treatment of wool fabrics and garments with ozone and steam to provide shrink resistance to the fabric or garment. The process is based on the reaction of the ozone with the wool fibers.

It should be understood that the term "dye" as used herein is meant to include any of the materials which are used to provide a color to a fabric such as conventional dyes, pigments, or the like. The term "fabric" as used herein is meant to include woven and non-woven cloth, knitted fabrics, garments, and the like.

It should be understood that the term "ozone and steam" as used herein denotes a preferable method of the invention and is meant to include ozone alone or ozone diluted with inert gases.

SUMMARY OF THE INVENTION

In accordance with the invention there is provided a process for selectively decolorizing a fabric containing cellulosic material having an oxidizable coloring agent such as a dye, pigment, organic or inorganic residues, and the like. The fabric may comprise cotton, linen, or other bast fibers or rayon alone or in combination with other materials including natural and synthetic fibers, for example, wool, nylon, polyester, and the like.

The oxidizing agent can be gaseous or a liquid or a solid oxidant in a vapor state. Gaseous oxidizing agents include ozone, $NO_x$ and $SO_x$. These gases can be used alone, in admixture or diluted with a inert or low reactive gases such as air. The oxidizing gases can be used in combination with steam or in an aqueous system.

The non-gaseous oxidants:should be used in a vapor phase, preferably with wetted fabrics. More preferably, the non-gaseous oxidants are used in combination with steam. Hydrogen peroxide solution diluted with steam is a preferred non-gaseous oxidant.

The oxidant, for example, ozone primarily reacts with the colorant on the fabric When the fabric is wet. Therefore, the garment is wetted or treated in a wet state. The water content of the wetted fabric when treated in the vapor phase is preferably about 20 to 40% by weight or higher depending upon the degree of treatment, the type of oxidant and the effect desired. The process may either be batchwise or continuous and is performed in a chamber in which the oxidant is generally present in an amount of about 10 to 100 mg. per liter. The oxidant and the steam are injected into the chamber so as to provide a temperature in the chamber of about 40° to 100° C., preferably 50° to 65° C. In the absence of steam, heating elements in the chamber can be used to maintain the temperature. Any excess oxidant emitted may be recycled back into the chamber or used to treat any effluent of the process.

In accordance with a preferred embodiment of the invention, one or more fabrics having an oxidizable coloring agent which have been treated with an oxidation blocking agent or dyes of different reactivity or sensitivity to an oxidant are placed in an enclosed chamber. The oxidant is emitted into the chamber so as to react with the colorant of the fabric. The concentration of the oxidant in the chamber in a vapor phase is maintained between 10 to 100 mg per liter by monitoring with an ozone photometer. When the fabric reach a predetermined color, that is, the colorant has undergone a desired degree of decoloration with the oxidant whereby a desired color is obtained, the reaction is terminated prior to any substantial reaction of the oxidant with the cellulosic material of the fabric.

According to another embodiment of the invention, a cellulosic fabric with an oxidizable colorant is contacted with ozone or other oxidants with or without steam in an extractor.

Still another embodiment of the invention provides the recycling of the oxidizing gas alone or within a liquid to other steps of the fabric treatment process to either treat the fabric or the effluent to make it environmentally safe.

It is a general object of the invention to fade or decolorize fabrics containing an oxidizable colorant.

It is a further object of the invention to decolorize dyed garments with ozone without degrading the fabric.

It is yet still further object of the invention to selectively and/or evenly decolorize or fade dyed garments to produce fashion garments.

It is another object of the invention to provide garments with different degrees of color by use of dyes of varying ozone sensitivity and/or to provide different levels of colorization throughout the garment.

It is also an object of the invention to either avoid yellowing or to eliminate yellowing in fabrics and garments.

It is yet another object of the invention to recycle the oxidizing agents used in the process to either further treat the fabric or to treat effluent from the process and make it environmentally acceptable.

Other objects and a fuller understanding of the invention will be had by referring to the following description and claims of a preferred embodiment, taken in conjunction with the accompanying drawings.

DESCRIPTION OF THE PREFERRED EMBODIMENTS

Figure 1:
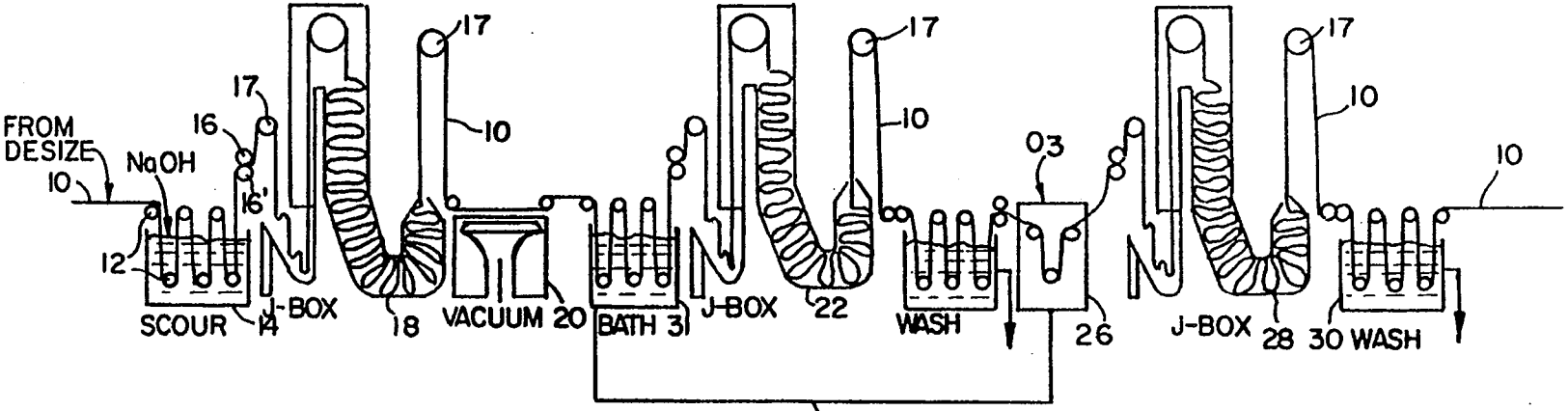
FIG. 1 is a schematic view of one form of a fabric treatment apparatus of the invention, and, FIG. 2 is a schematic view of a process of the invention for treating garments.

Although specific terms are used in the following description for the sake of clarity, these terms are intended to refer only to the particular structure of the invention selected for illustration in the drawings and are not intended to define or limit the scope of the invention.

FIG. 1 schematically represents a typical fabric treatment process with several treatment areas which includes the various embodiments of the present invention so as to result in a dyed cellulosic fabric in which undesirable colorants are oxidized and/or the dye is decolorized or faded. The treatment also reduces the yellowing which occurs upon long term storage of the fabric.

As shown, a dyed cellulosic fabric 10 is preferably passed in countercurrent flow through a scouring bath 14 by means of rolls 12 in a continuous process. However, the process may be carried cut step-wise or batchwise depending upon the fabric.

The scouring bath 14, which generally comprises a 2 to 10% solution of sodium hydroxide and about 0.1 to 0.5% detergent, is at ambient to elevated temperature (about 100° C.). If desired, an oxidizing gas such as ozone may optionally be added to the bath according to the process.

Following the scouring bath, the fabric is conveyed to a steamer 18 after passage through contact or squeegee rolls 16, 16' and a conveyor roll 17. The treatment in the steamer 18 is usually for a period of about one half hour.

After the steam treatment the fabric is conveyed from the steamer 18 over a conveyor roll 17 to a vacuum or aspirator means 20 for removal of a substantial portion of any residual sodium hydroxide solution. Also, the fabric may be washed with brine or water to remove alkaline residue from the fabric in bath 31.

The fabric 10 can be further steamed in J-box 22 and passed into a wash bath so as to wet the fabric prior to treatment with ozone.

The wet fabric is then passed into an ozone treatment apparatus 26. The length of time that the fabric 10 remains in contact with ozone within the apparatus 26 is dependent upon the purpose of the ozone treatment. A shorter stay of the fabric 10 within the apparatus 26 usually occurs if the ozone treatment is to prevent or remove yellowing. When the fabric 10 is to be faded or decolorized, ozone may be injected into the apparatus 26 together with steam. Excess ozone or ozone and steam may be recycled back into apparatus 26 or sent through line 27 to other treatment areas including the treatment of waste. The recycling is beneficial since excess ozone need not be further treated before passing into the environment and ozone treatment of waste effluent satisfies environmental guidelines.

It is understood that in combination with ozone or in lieu of ozone there may be used other oxidizing gases such as chlorine, nitrous oxides and/or sulfur oxides. For example chlorine when added to water produces hypochlorous acid (HOCl). Even under alkaline conditions a portion of the sodium hypochlorite (NaOCl) exists as the hypochlorous acid. For example in the study by Ridge and Little (J. Text. Inst., 1942, 33T, p. 59) the equilibria at different pH values are governed by the reactions:

$$HOCl \rightarrow H^+ + OCl^-$$

and $$HOCl + H^+ + Cl^- \rightarrow Cl_2 + H_2O$$

The fraction of the hypochlorite existing as free hypochlorous acid increases as the pH falls below 10. At pH of 5, all of the chlorine is in the hypochlorous acid form. Under neutral conditions about 73% exists in this form. Thus, chlorine added to neutral or slightly acidic steam will contain high amounts of oxidant as hypochlorous acid. Areas of the fabric which may need to be protected from the oxidizing effects of the hypochlorous acid can be coated with a preferential reaction product (blocking agent) such as starch. That is, the starch will be preferentially attacked by the hypochlorous acid and the underlying substrate (cotton, rayon etc.) will be protected and not undergo any significant bleaching or decolorization. Also, if the fabric is wet, chlorine gas will primarily react with the water to form HOCl according to the reaction.

$$H_2O + Cl_2 \rightarrow HOCl$$

and will bleach the fabric only in the wet areas. If dyed wool is to be processed by this method it may be satisfactory to use sulfur dioxide in the steam to achieve the same bleaching effect that chlorine will have on the non-wool garment.

Another oxidant that will be somewhat soluble in the steam is peracetic acid. It is used primarily as a bleaching agent for nylon.

Following treatment with the oxidizing gases the fabric can be further steamed in J-box 28 and passed into the final wash 30 prior to passage for further treatment.

Figure 2:
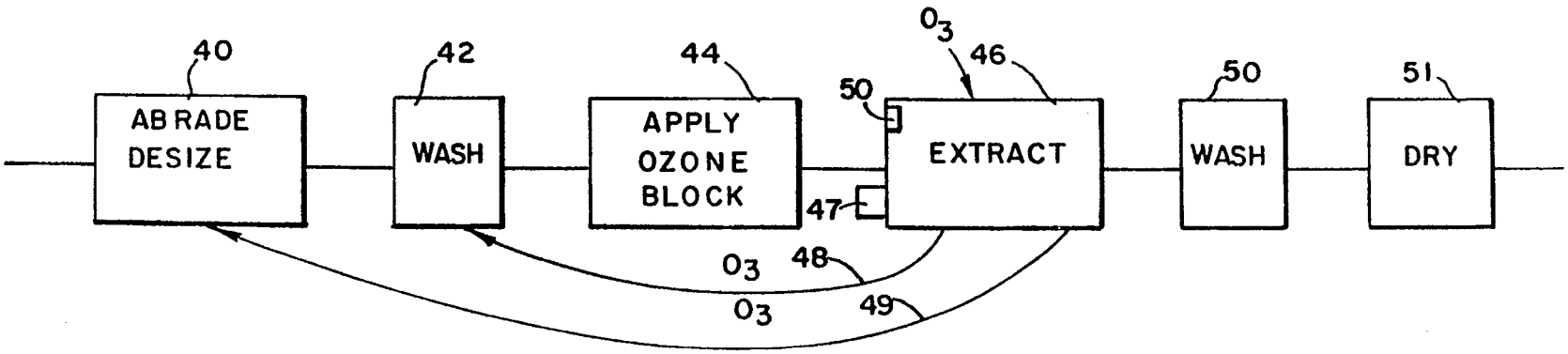

FIG. 2 illustrates the process of the invention in connection with the treatment of garments such as denim jeans. The jeans which have been previously dyed and sized are placed in an abrading and desizing apparatus 40. The desizing and abrasion steps are conventional in the field. Chemicals or enzymes can be used to desize. The abrasion aids in the desizing and in addition provides a fashion look. Addition of ozone in this stage of the process not only aids in desizing but also initiates the start of decolorizing the garment. In some cases only partial desizing may be required since the sizing can act as a blocking agent for the oxidant.

After the abrasion and desizing, the garments are washed in a washer 42 one or more times to remove the sizing and other chemicals. The garments while still wet from the wash can be optionally treated with an ozone blocking agent in apparatus 44. Typically, clay is sprayed onto the garments while still wet so that the clay adheres. Alternatively, the garments could be dried and hydrocarbon oils, greases or waxes are sprayed onto the garments. Masking tape can also be used to provide special effects. Some starch may be left in the garments so as to act as a preferential reaction medium for the ozone.

Preferably, the garments while still wet are placed in an extractor in which an oxidizing gas such as ozone is injected. Preferably, the extractor 46 is provided with a heating means 47 such as steam coils or thermocouples. When steam is injected together with ozone a furthers heating means is generally not required. The temperature within the chamber is generally about 40° C. to 100° C. preferably about 50° to 65° C. The ozone in the chamber of the extractor 46 may be monitored with an ozone photometer, such as a Dasibi Model 1003 HC ozone photometer. There are alternative methods for determining the termination or end period for the ozone treatment. One method involves the prior use of test fabrics to determine the operating parameters. Another method which can be used is visual inspection.

It is understood that dry garments may be placed in the ozone chamber and that they are wetted by the steam.

Excess ozone and ozone containing extract can be recycled back into the extractor 46 or through lines 48 and/or 49 to initiate decolorization at an earlier stage. It has been found to be helpful to include ozone in the desizing step when the desizing is performed with a chemical.

The ozone and ozone containing fluid from the extractor can also be used to treat the effluent from the desizing and wash apparatuses 40 and 42 prior to release in the environment.

After the ozone treatment the garment can be washed or post treated to remove the oxidation blocking agents in apparatus 50 and then dried in apparatus 51.

The type of dye used on the garment is not critical. It is only important that the dye is ozone reactive where intended. Cellulose substantive dyes, such as vat dyes, which are common in the garment industry, are preferably used. Exemplary of the dyes which are substantive to cellulose or blends of cellulose with synthetic fibers that can be used include, Sevron Brilliant Red 2B, indigo vat dye, a cationic dye, Sulfonine Brilliant Red B, an anionic dye, Brilliant Milling Red B, C. I. Disperse Blue, pyrazolone azomethine dye, hydroxy azo dyes, or the like. Where the dye is a xanthene dye, treatment also gives rise to chemiluminescence in the process. Other suitable dyes that can be used are identified in the paper of Charles D. Sweeney entitled, "Identifying a Dye can be Simple or it Can Involve Hours of Laboratory Analysis", Textile Chemist and Colorist, Vol. 12, No. 1, January 1980, pp 26/11.

The garments may be treated with one or more dyes. Utilizing dyes of differing degrees of ozone reactivities provides the garment with zones of different appearances or effects. For example, faded, stone washed, ice-washed, sand blasted or mottled effects may be obtained. The same effect can be achieved by utilizing ozone blocking agents. The ozone blocking agents may comprise organic materials such as pearl starch, modified or derivitized starches, hydrocarbon oils, greases or waxes or inorganic materials such as clay. Masking tape, or other coverings may be used. A further alternative method to achieve a special effect is to partially or selectively wet the garment since the ozone-dye reaction effectively takes place where the garment is wet.

The ozone generally does not react with the fabric where it is not wet.

The blocking agent can also be any chemical agent which itself is reactive with ozone but prevents or blocks a dye or portion of a dye on the fabric and prevents it from becoming decolorized.

It is understood that the reaction period and amount of ozone utilized is dependent upon different factors. That is, the time and amount of ozone depends upon the effect desired, the type of dye utilized, the temperature, degree of wetness, etc. Longer treatment at lower concentrations of ozone can result in the same effect as a short treatment with a large excess of ozone on the same dyes. Therefore, the sensing of the conditions in the reaction chamber is essential to optimize the present process.

The ozone within the chamber is preferably measured periodically and kept at a minimal and within the range of about 10 to 100 mg per liter. The ozone can be generated by on ozone generator of the type available from Griffin Technics, Inc., Model GTC-2B which produces ozone from dry air or oxygen using electrical circuit breakers or Corona discharge. The ozone may be used alone or diluted with inert gases.

A garment to be faded, such as denim blue jeans, is generally first laundered to remove any sizing or fashion process coatings or materials which may interfere with the process of the invention. For example starch can act as an ozone blocking agent. The washing operation could include desizing using enzymes, as is common in the industry followed by laundering to cleanse the garment. The garment is then hydroextracted or padded dry so as to remove excess water. The water content of the garment should be about 20–40% by weight. If the garment is not wet, then it can be wetted by water spraying or placing it within a water bath.

The garment is treated with a blocking agent which is determined on the effect desired. For example, if a sand blasted or stone washed effect is desired, the wet garment can be sprayed with clay or some other inorganic powder to act as an ozone blocker. However, if a mottled look is desired, the garment may be treated with a suitable hydrocarbon oil, grease or wax which shields parts of the garment from the effects of ozone in a selected manner. The garment can be printed, the color can be applied by painting or using a mordant.

In lieu of the ozone blocking, special effects can also be achieved by selectively treating the garment with dyes having different degrees of ozone reactivity. The different dyes can be added earlier in the process so that the use of ozone blocking agents becomes optional. The non-reactive or lesser ozone reactive dyes may be applied by spraying, brushing, dipping, or the like in the same manner as placing the oxidation blocking agents. The non-reactive dyes include the pigment colors.

The following example is illustrative of the invention, but is not to be construed as to limiting the scope thereof in any manner. The percentages herein disclosed relate to percent by weight.

EXAMPLE 1

A. A lot of 30 cotton denim blue jeans vat dyed with a blue indigo dye (CI Vat Blue 1) were washed in a standard laundry detergent at 120° F. in a conventional washer which includes a spin extractor. The garments after extraction had a moisture content of about 35% by weight. One half (15) garments were removed and the remaining were treated for 25 minutes in an ozone atmosphere while still in the laundering machine.

All of the garments were dried and stored for six (6) months.

The garments which were not treated with ozone showed significant yellowing. The garments which were post treated with ozone did not show any signs of yellowing.

B. All of the garments which showed yellowing were washed as in Step A and placed in the extractor. After extraction the garments had a moisture content of about 35%. The garments were treated with ozone for twenty five (25) minutes the same as in Step A. The yellow color disappeared.

EXAMPLE 2

The following experiments were performed to determine the degree of degradation of the fabric based on the warp yarn which contains the dye.

Experimental Procedures

Grab Break tests were determined using ASTM Test method D-1682 Five breaks for the warp yarn were made for each sample and averaged. Abrasion tests were determined according to ASTM method D-3885 (stoll flex). Five samples were run and averaged. The fabrics were standard Levi style 501 garments.

Results

The overall results are given in Table 1. A standard ice wash procedure was used as the control.

A. Comparison of Ozone treated fabrics to chlorine treated fabrics.

The results for chlorine (Sodium Hypochloride) treatments are shown both in Table 1. The treatment was done at normal (C1) medium (C2) and high (C3) chlorine contents in order to obtain increasing levels of color removal ranging from a medium blue to white. These treatments were matched to various ozone treatment times needed to achieve the same level of color removal. For example, C1 matched the ozone treatment for 1 hour while C2 matched the ozone treatment for 1.5 hours. No ozone treatment matched the C3 (totally white) jeans which is included for completeness. From the results it is observed that the ozone treated fabrics do not loose as much warp strength as the chlorine bleached fabrics. It is the warp yarns which contain the indigo dye.

B. Ozone Treatments

Fabrics were treated with ozone for 0.5 to 2.0 hours. The test results are given in Table 1 and shown graphically in the attached bar graphs. The fabric color become lighter with increasing time of ozone treatment. The color (dye) level in the garments was monitored by a Bausch and Lomb Color Scan Spectrophotometer C. Ozone treatment of an ice washed garment.

An ice washed garment (control) was treated for 15 minutes in an ozone atmosphere (sample 03 ¼ hr.). Some loss in strength resulted, however, considerable abrasion resistance was restored (See Table 1 or bar graphs). The other surprising result was that the blue shade of the unbleached portion of the ice washed fabric could be further reduced in color to give a shading affect that cannot be achieved by the original ice washing technique. Further, ice washing produces a yellow color (staining) in the white (bleached) regions of the garment which reduces the garment attractiveness. This yellow color (dye) is due to breakdown fragments (compounds) of the indigo dye which remain in the fabric to discolor the white background. The ozone treatment was effective in decolorizing these yellow compounds and gave a superior "white" background to the garments. That is, the ozone treatment corrects a major defect of ice wash treatments.

TABLE 1

Comparison of strength (Grab Break and Abrasion) for various Fabric Treatments

| Treatment (Cycles) | | Test Results Grab Break (lbs) W | Abrasion W |
|---|---|---|---|
| Ice Washed (Control) | | 174 | 5473 |
| Ozone (03) | 0.25 Hrs | 139 | 9014 |
| | 0.50 Hrs | 224 | 9527 |
| | 1.0 Hrs | 245 | 20428 |
| | 1.5 Hrs | 195 | 8906 |
| | 2.0 Hrs | 174 | 5588 |
| Chlorine | | | |
| (C1) | Medium Blue | 225 | 14080 |
| (C2) | Light Blue | 179 | 5823 |
| (C3) | White | 143 | 3266 |

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A method for decolorizing and preventing yellowing during storage of cellulosic fabric which has been dyed with an oxidizable dye which comprises the steps of contacting said fabric prior to storage with an oxidizing agent in a vapor or gas phase in the presence of moisture and then terminating the contact with said oxidizing agent prior to any degradation of said fabric.

2. The method of claim 1 wherein said oxidizing agent is ozone.

3. The method of claim 1 wherein said oxidizing agent is selected from the group consisting of nitrous oxide, sulfurous oxide and chlorine with steam.

4. The method of claim 1 wherein said contact with an oxidizing agent is at a temperature of about 40° to 100° C.

5. A fabric treated by the method of claim 1.

* * * * *